US006749098B2

(12) United States Patent
Roier et al.

(10) Patent No.: US 6,749,098 B2
(45) Date of Patent: Jun. 15, 2004

(54) WEB-TENSION-REGULATING DEVICE FOR A CORRUGATING MACHINE

(75) Inventors: Paulus Roier, Poppenricht (DE); Alfons Gnan, Vilseck (DE); Heribert Reich, Weiherhammer (DE)

(73) Assignee: BHS Corrugated Maschinen-und Anlagenbau GmbH, Weiherhammer (DE)

( * ) Notice: Subject to any disclaimer, the term of this patent is extended or adjusted under 35 U.S.C. 154(b) by 21 days.

(21) Appl. No.: 10/179,225

(22) Filed: Jun. 26, 2002

(65) Prior Publication Data

US 2002/0195515 A1 Dec. 26, 2002

(30) Foreign Application Priority Data

Jun. 26, 2001 (DE) ..... 101 30 340

(51) Int. Cl.[7] ..... B65H 23/16
(52) U.S. Cl. ..... 226/34; 242/418
(58) Field of Search ..... 226/34, 42, 118.2; 242/418, 418.1, 419.7, 419.9, 417.3, 908

(56) References Cited

U.S. PATENT DOCUMENTS

| | | | | |
|---|---|---|---|---|
| 3,946,919 A | * | 3/1976 | Ernst | 226/11 |
| 4,124,156 A | * | 11/1978 | Waffner | 226/25 |
| 4,220,274 A | * | 9/1980 | Schubert et al. | 226/34 |
| 4,645,109 A | * | 2/1987 | Fleissner | 226/42 |
| 4,813,357 A | * | 3/1989 | Ward et al. | 101/483 |
| 5,049,216 A | | 9/1991 | Shead et al. | |
| 6,068,172 A | * | 5/2000 | Huber | |
| 6,193,184 B1 | | 2/2001 | Hansen | |

FOREIGN PATENT DOCUMENTS

| | | |
|---|---|---|
| CH | 292 425 | 11/1953 |
| DE | 7 40 238 | 10/1943 |
| DE | 12 86 367 | 1/1969 |
| DE | 199 23 204 | 11/2000 |
| DE | 195 12 963 | 7/2001 |
| EP | 0 464 616 | 9/1991 |
| GB | 954934 A | 4/1964 |
| GB | 1 436 043 | 5/1976 |
| JP | 54 103960 A | 8/1979 |
| WO | WO 98/19948 | 5/1998 |

* cited by examiner

*Primary Examiner*—Kathy Matecki
*Assistant Examiner*—Evan H Langdon
(74) *Attorney, Agent, or Firm*—Browdy and Neimark

(57) ABSTRACT

A device for regulating the tension of a moving web of material, in particular a web of paper in a paper-working machine such as a corrugating machine, comprises a machine frame; a first roller that is mounted for rotation about a first axis of rotation in relation to the machine frame, taking up a web of material by an angle of contact a; and a supporting device, which supports itself on the machine frame, and which is mounted for pivoting about the first axis of rotation by a pivoting drive, and which supports at least a second roller mounted for rotation about a second axis of rotation that is substantially parallel to the first axis of rotation; wherein the angle of contact a of the web of material on the first roller is modifiable by the at least one second roller being pivoted about the first roller.

7 Claims, 7 Drawing Sheets

WEB-TENSION-REGULATING DEVICE FOR A CORRUGATING MACHINE

BACKGROUND OF THE INVENTION

1. Field of the Invention

The invention relates to a device for regulating the tension of a moving web of material, in particular a web of paper in a paper-working machine such as a corrugating machine.

2. Background Art

A single facer for the manufacture of single-faced board is known from WO 00/00347, in which a liner and a medium are supplied to the unit for the manufacture of corrugated board. Prior to this, the liner is led around a cylinder, in the surface of which are provided numerous ports with water vapor exiting there-from for increased feeding of water into the liner. This arrangement is not capable of regulating and defining the tension of the liner web. Drawbacks of this arrangement further reside in that embodying the cylinder with corresponding steam passages is extraordinarily complicated. Moreover, quite a lot of vapor escapes unused in the peripheral areas of the cylinder that are not encircled by the liner web. Consequently, it is rather difficult, owing to this inaccuracy in the supply of water vapor, to pre-select and regulate the friction between the cylinder and liner web and thus the web tension that will result downstream of the cylinder.

SUMMARY OF THE INVENTION

It is an object of the invention to embody a device for regulating the tension of a moving web of material by which to regulate the web tension as precisely and in as simple a way as possible.

The object is attained in that the angle of contact a of the web of material on the first roller is modifiable by the at least one second roller being pivoted about the first roller. The gist of the invention resides in providing a first roller and at least a second roller that is mounted for pivoting about the first roller, with a web of material being passed around the first roller and the at least second roller. By the second outer roller being pivoted about the first inner roller, the angle of contact of the web of material on the first roller can be modified, and thus the friction between the web of material and the first roller. This helps affect the tension of the web of material downstream of the first roller.

Additional features and details of the invention will become apparent from the description of two exemplary embodiments, taken in conjunction with the drawing.

DESCRIPTION OF THE PREFERRED EMBODIMENTS

Figure 1:
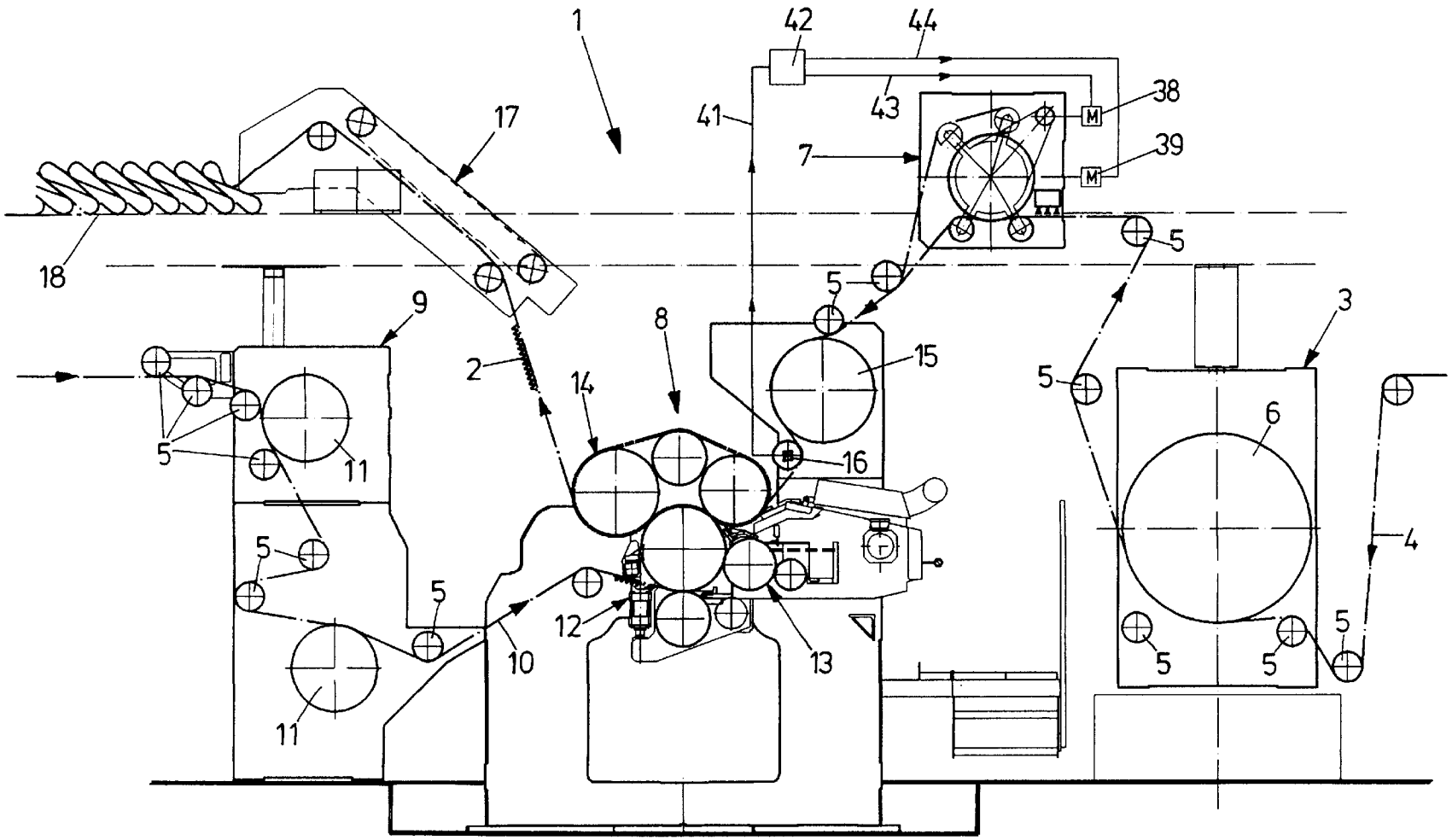
FIG. 1 is a lateral view of a detail of a corrugating machine with a web-tension-regulating unit in a first embodiment.
Figure 2:
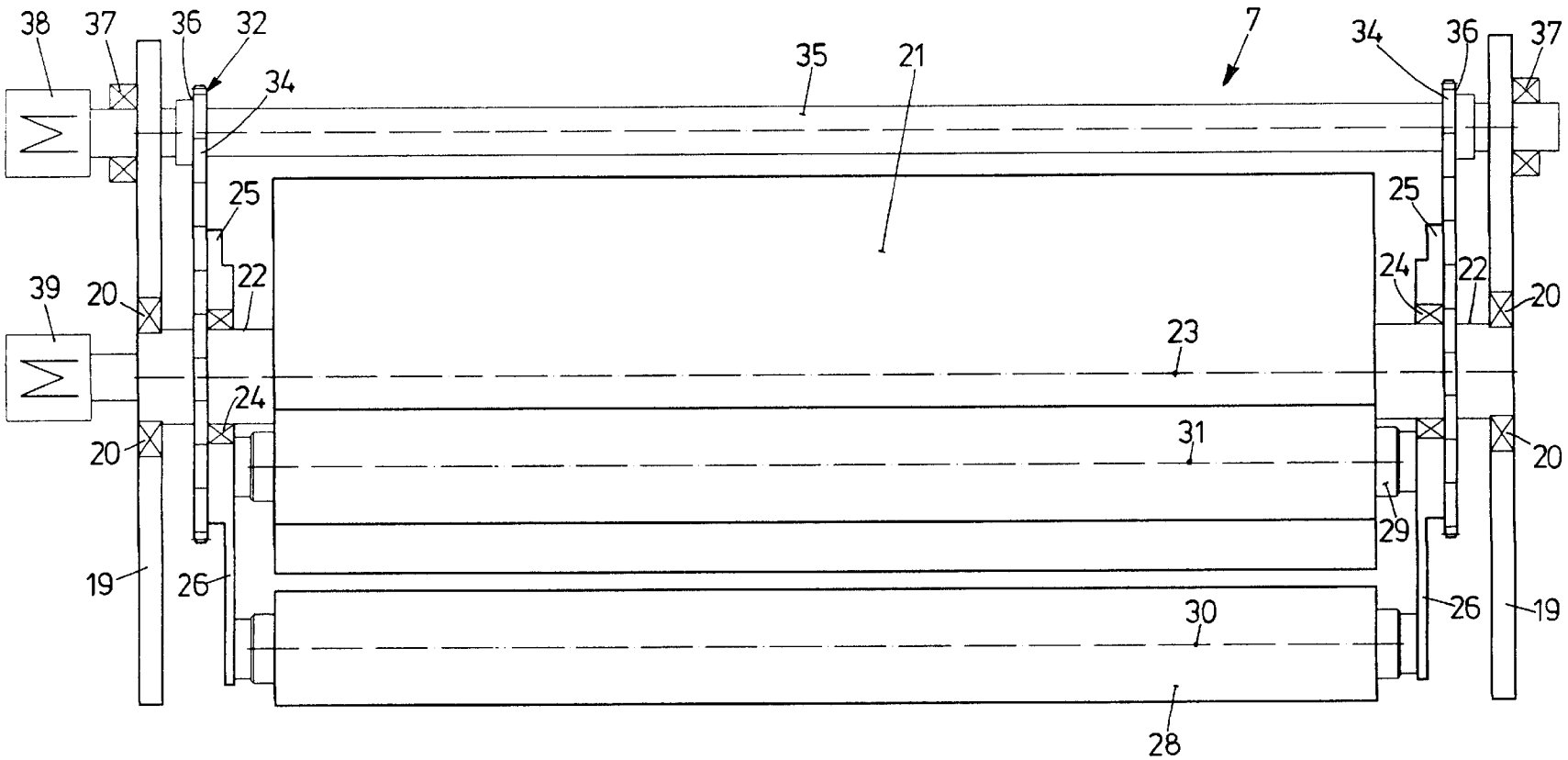
FIG. 2 is a plan view of the web-tension-regulating unit according to FIG. 1.

The following is a description of a first embodiment of the invention, taken in conjunction with FIGS. 1 to 4. A machine 1 for the manufacture of a web of single-face board 2 comprises a liner web delivery unit 3, with a liner web 4 being passed around several deflection rollers 5 and around a preheating roller 6 also designated as a pre-heating cylinder for heat-up of the liner web 4. Then the liner web 4 is led through a web-tension-regulating unit 7 that serves for regulating the tension of the liner web 4 and will be described in detail below. Then the liner web 4 is fed, via further deflection rollers 5, to a corrugated-board-manufacturing unit 8. A web of board termed the medium 10 is supplied to the corrugated-board-manufacturing unit 8 by a medium delivery unit 9. In the medium delivery unit 9, the medium 10 is passed over several deflection rollers 5 as well as two preheating rollers 11, also called pre-heating cylinders, and is then delivered to the corrugated-board-manufacturing unit 8. This comprises a fluted unit 12 for the medium 10 to be corrugated. Then the corrugated medium 10 is passed along the adhesive applicator unit 13 and, in a nip pressure unit 14, united with the liner web 4 that is trained over a pre-heating roller 15 (also pre-heating cylinder) and a web tension sensor 16. The finished web of single-face board 2 is discharged upwards via a discharge unit 17 and temporarily stored in a place of deposit 18. The units 3, 8, 9, 12, 13, 14, 17 are elements of a corrugating machine 1 that have been known for a long time.

The following is a description of a first embodiment of the invention, taken in conjunction with FIGS. 1 to 4. A machine 1 for the manufacture of a web of single-face board 2 comprises a liner web delivery unit 3, with a liner web 4 being passed around several deflection rollers 5 and around a pre-heating roller 6 also designated as a pre-heating cylinder for heat-up of the liner web 4. Then the liner web 4 is led through a web-tension-regulating unit 7 that serves for regulating the tension of the liner web 4 and will be described in detail below. Then the liner web 4 is fed, via further deflection rollers 5, to a corrugated-board-manufacturing unit 8. A web of board termed the medium 10 is supplied to the corrugated-board-manufacturing unit 8 by a medium delivery unit 9. In the medium delivery unit 9, the medium 10 is passed over several deflection rollers 5 as well as two pre-ends in bearings 37 in relation to the machine frame 19. The shaft 35 is drivable by a motor 38 that is joined to it. The gear rims 36 have an outside diameter $D_K$. The transmission ratio that the small gear rim 36 bears to the great gear rim 33 is $D_Z/D_K \approx 4$, other transmission ratios being conceivable too. The main roller 21 is driven for rotation by a motor 39 that is connected to the bearing journal 22, with the tangential outer peripheral velocity of the roller 21 being $v_W$. The unit of the two pulleys 25 inclusive of the arms 26, 27 and the rollers 28 and 29 is designated as a supporting device.

A humidifier unit 40 is provided where the liner web 4 is delivered to the unit 7, spraying water vapor on the side of the liner web 4—the upper side in FIGS. 3 and 4—that is subsequently turned towards the main roller 21. The liner web 4, prior to reaching the main roller 21, has a velocity termed $v_B$. The liner web 4, while passing around the rollers 21, 28 and 29, is trained through the nip between the roller 29 and the roller 21 and then through the nip between the roller 28 and the roller 21. The liner web 4 rests on the main roller 21 by a variable angle of contact a.

For web tension determination, the web tension sensor 16 is provided in the unit 8 between the pre-heating roller 15 and the nip pressure unit 14, taking the tension of the liner web 4 and transmitting a corresponding signal via a line 41 to a central control unit 42. Via lines 43 and 44, the control unit 42 is connected with the motors 38 and 39.

The following is a description of how the web-tension-regulating unit 7 works. The tension of the liner web 4 downstream of the unit 7 is affected by two variables, one of them consisting in how rapidly the main roller 21 is driven. For braking the liner web 4 i.e., for increasing the web tension downstream of the unit 7, the peripheral velocity $v_W$ of the main roller 21 is lower than the velocity $v_B$ of the liner web. In the extreme, the main roller 21 does not rotate. Another possibility of web tension modification resides in modifying the angle of contact a of the liner web 4 around the main roller 21, which changes the frictional force between the surface of the main roller 21 and the liner web 4.

Figure 3:
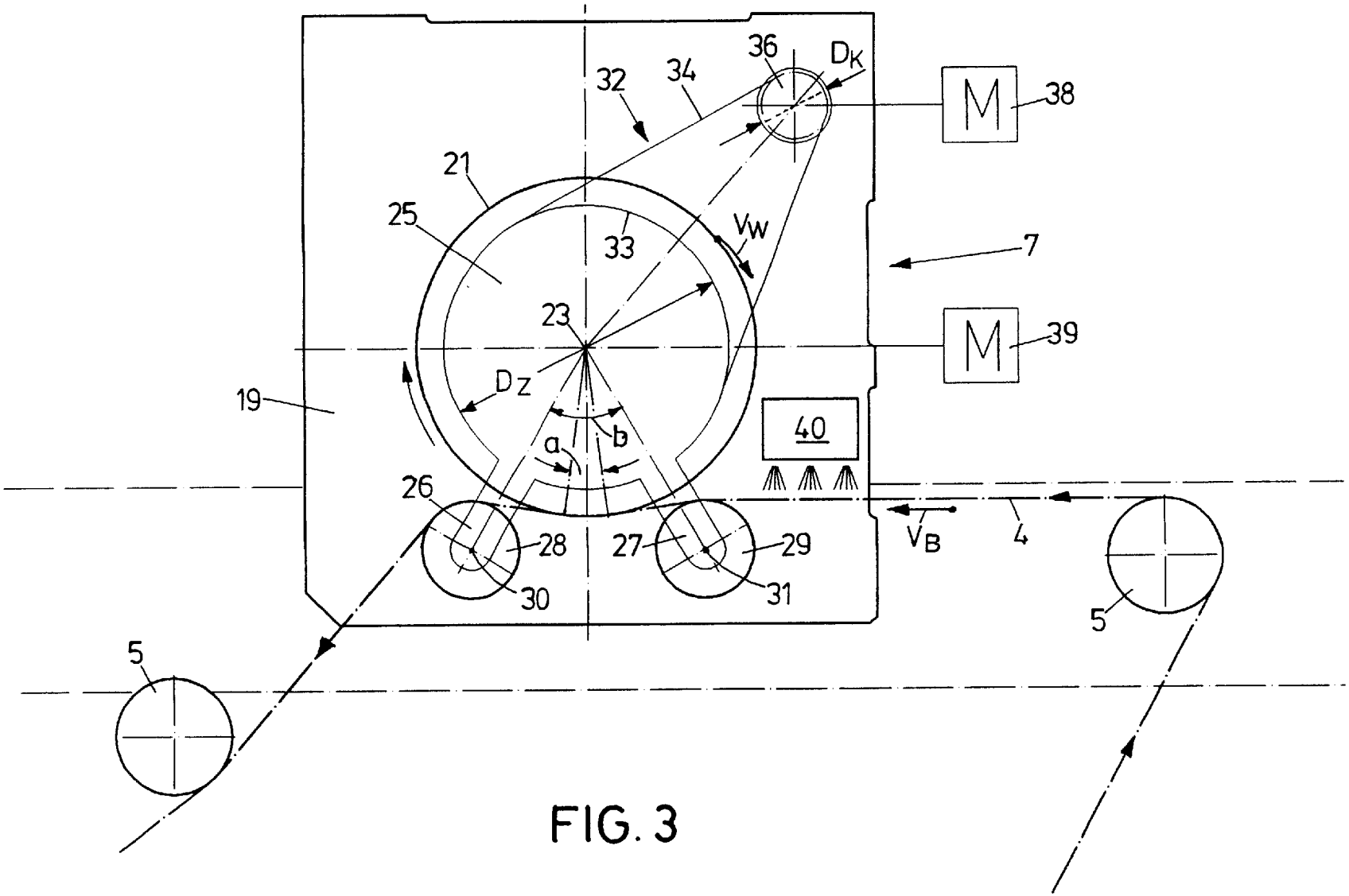
FIG. 3 is a lateral view of the web-tension-regulating unit according to FIG. 1 in a first position.
Figure 4:
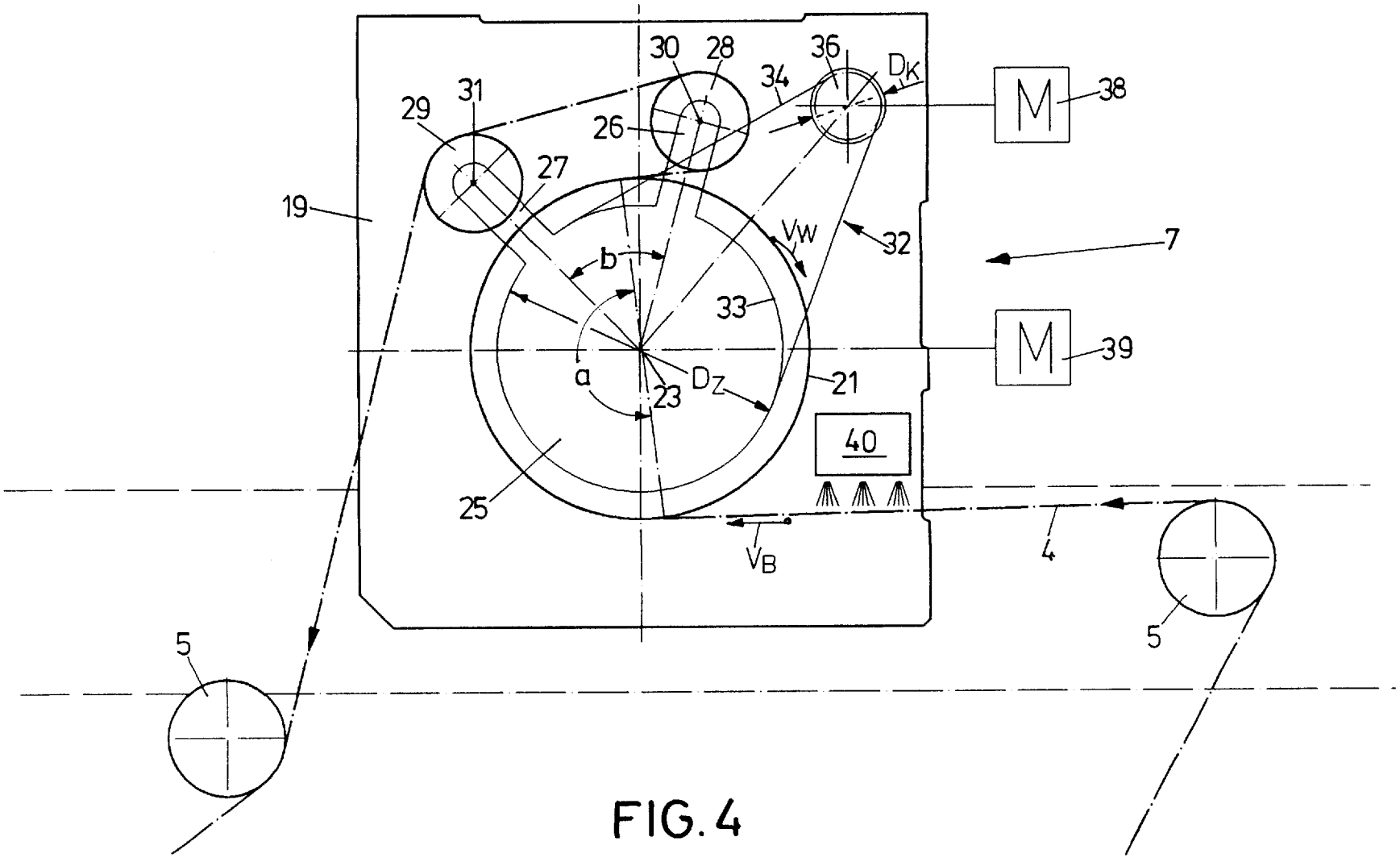
FIG. 4 is a lateral view of the web-tension-regulating unit according to FIG. 1 in a second position.

The position of the rollers 28 and 29 seen in FIG. 3 shows the smallest angle of contact a, to which a ≈10° applies. In this arrangement, the liner web 4 is supplied by the liner web delivery unit 3 to the web-tension-regulating unit 7, first passing the humidifier unit 40 which sprays water vapor on the upper side of the liner web 4, thus increasing the friction between the liner web 4 and the main roller 21 as compared to a dry liner web 4. Then the liner web 4 is slightly deflected by the roller 29 and passed along the main roller 21 by an angle of contact a, after which it is deflected on the roller 28 and led towards the corrugated-board-manufacturing unit 8. The web tension sensor 16 continuously takes the tension of the liner web 4. If the tension is too low, the control unit 42 transmits corresponding signals to the motors 38 and/or 39. For web tension increase, the velocity $v_W$ of the main roller 21 may be reduced. If this is not sufficient, the rollers 28 and 29 are pivoted clockwise by way of the motor 38 and the chain drive 32, with the angle of contact a increasing. FIG. 4 shows a position with a great angle of contact a. The supply of water vapor augments the friction between the liner web 4 and the main roller 21, which is in particular desirable for web tension regulation. Water vapor is supplied to the side of the liner web 4 that is turned towards the main roller 21. Moreover, the liner web 4 must have a certain humidity for adhesion to the medium 10 in the nip pressure unit 14 to be produced impeccably. The web-tension-regulating unit 7 enables the tension of the liner web 4 to be kept constant near the web tension sensor 16 i.e., directly prior to adhesion to the medium 10. Typically, the angle of contact a must be increased as the velocity $v_B$ of the liner web 4 increases for constant web tension to be maintained at the web tension sensor 16. It is also possible to determine the web tension by the current of the motor 38 of the pivoting drive. The higher the web tension, the greater is the energy to be mustered up by the motor 38—and thus the current needed—for keeping a certain angle of contact a. There is no need of a web tension sensor in the case of this simple type of web-tension measuring.

Figure 5:
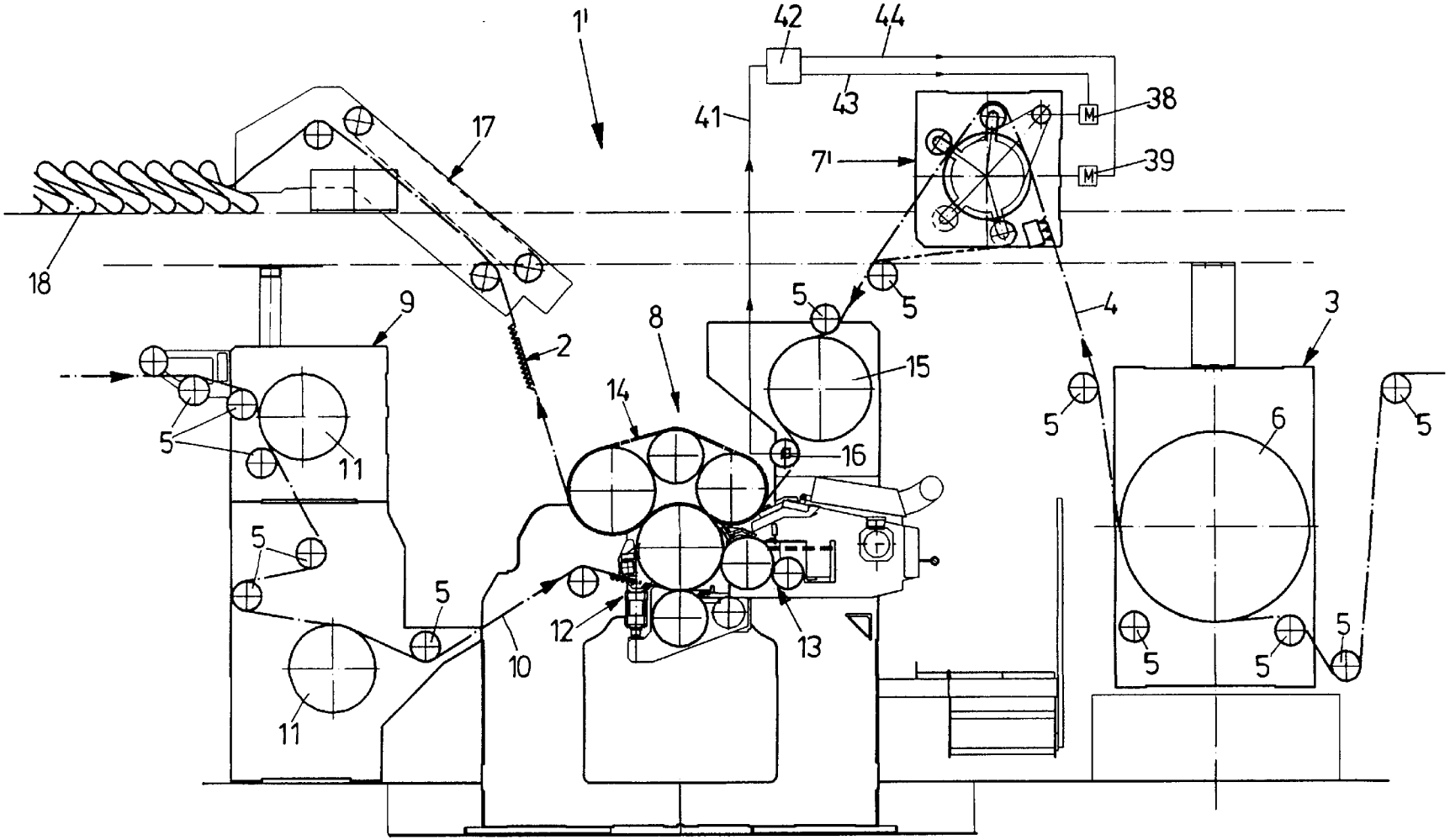
FIG. 5 is a lateral view of a detail of a corrugating machine with a web-tension-regulating unit in a second embodiment.
Figure 6:
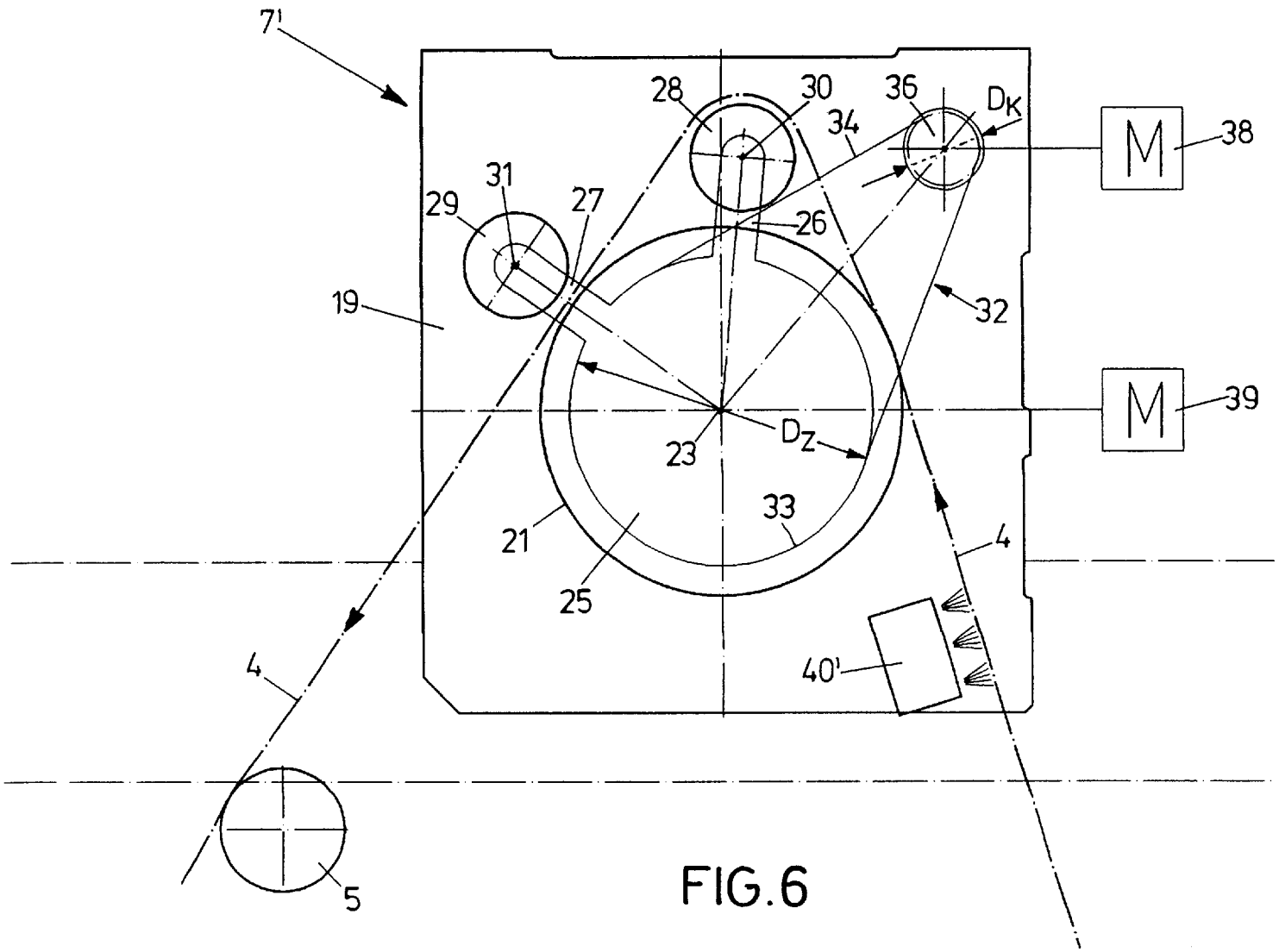
FIG. 6 is a lateral view of the web-tension-regulating unit according to FIG. 5 in a first position.
Figure 7:
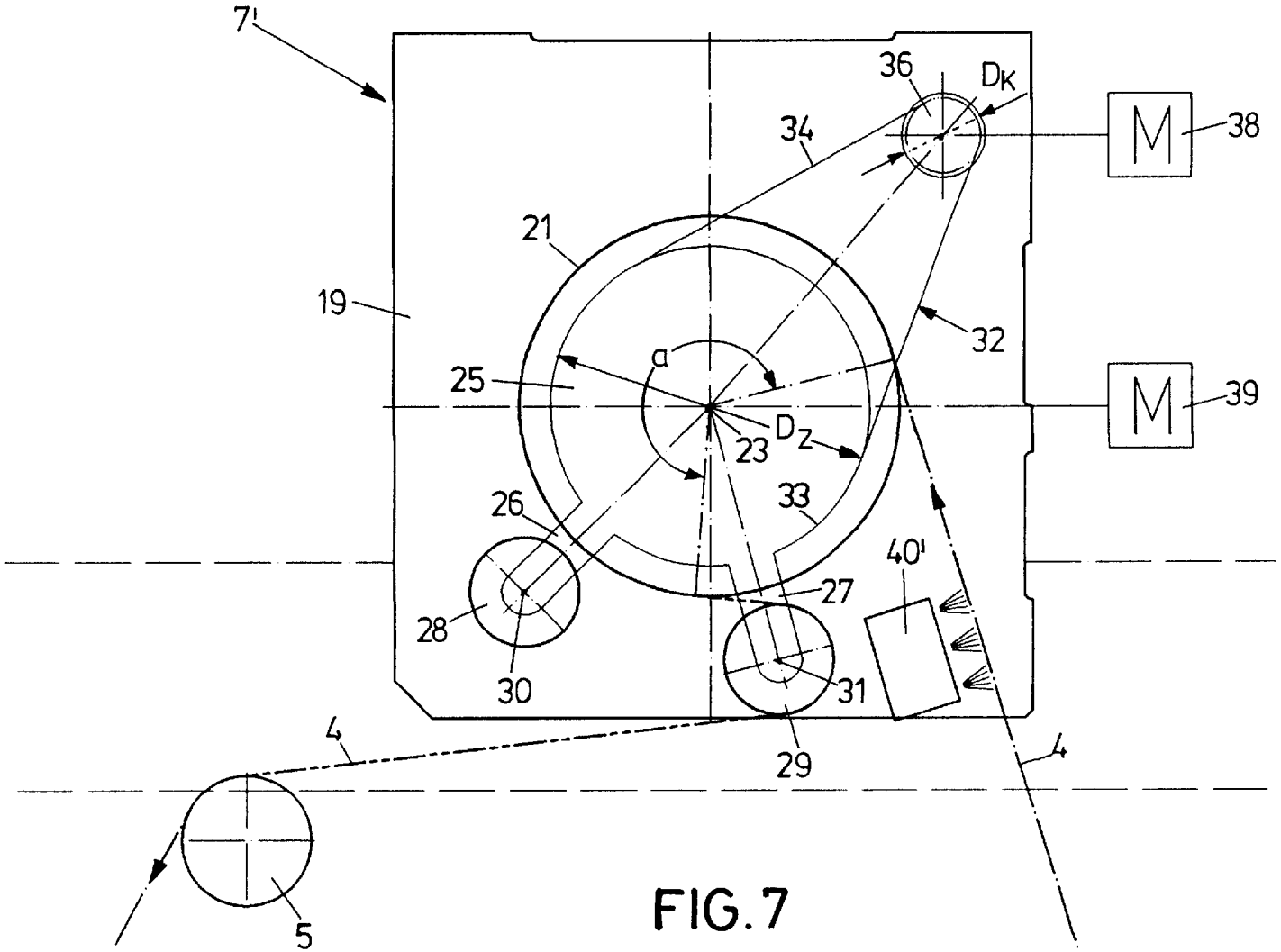
FIG. 7 is a lateral view of the web-tension-regulating unit according to FIG. 5 in a second position.

The following is a description of a second embodiment of the invention, taken in conjunction with FIGS. 5 to 7. Identical parts have the same reference numerals as in the first embodiment, the description of which reference is made to. Parts of identical function that differ in construction have the same reference numeral provided with a prime. The essential difference from the first embodiment resides in that the liner web 4 is passed over the main roller 21 instead of substantially below the main roller 21 as in the first embodiment. Correspondingly, the humidifier unit 40' is disposed underneath the liner web 4 in order for the side turned towards the main roller 21 to be moistened by vapor as with the first embodiment. FIG. 6 shows a position, corresponding to FIG. 3, of the rollers 28 and 29, in which the angle of contact a is minimal. In the case of the arrangement according to the second embodiment, it is possible, as seen in FIG. 6, to obtain an angle of contact of a=0° i.e., the liner web 4 does not at all contact the main roller 21 and is passed only around the roller 28 and led off through the nip between the roller 29 and the roller 21. In the case of this arrangement, there is the lowest frictional resistance as compared to all the other positions of the rollers 28 and 29. Pivoting the rollers 28 and 29 counter-clockwise about the axis of rotation 23 will increase the angle of contact a. FIG. 7 illustrates a situation with a great angle of contact of a≈270°. Advantages of the second embodiment as opposed to the first embodiment reside in that there is a wide range of angles of contact that can be set, in the present case 0°≦a≦270°. It is possible to set even greater angles of contact a.

What is claimed is:

1. A device for regulating the tension of a moving web of material, in particular a web of paper in a paper-working machine such as a corrugating machine, comprising a machine frame (19);

a first roller (21) that is mounted for rotation about a first axis of rotation (23) in relation to the machine frame (19), taking up a web of material (4) by an angle of contact a; and a supporting device, which supports itself on the machine frame (19), which is mounted for pivoting about the first axis of rotation (23) by a pivoting drive, and which supports at least a second roller (28, 29) mounted for rotation about a second axis of rotation (30, 31) that is substantially parallel to the first axis of rotation (23);

wherein the angle of contact a of the web of material (4) on the first roller (21) is modifiable by the at least one second roller (28, 29) being pivoted about the first roller (21);

wherein a humidifier unit (40; 40') is provided for the supply of humidity to the web of material (4);

wherein the web of material (4) has a conveying direction and the humidifier unit (40; 40') is disposed upstream of at least one of the first roller (21) and second roller (28; 29) along the web of material (4); and wherein the humidifier unit (40; 40') is disposed on a side of the web of material (4) that is turned towards the first roller (21).

2. A device according to claim 1, wherein the humidifier unit (40; 40') is a unit for the delivery of water vapor.

3. A device according to claim 1, wherein the first roller (21) is drivable by a fist motor (39) so that the first roller (21) has a pre-determinable tangential peripheral velocity $v_W$.

4. A device according to claim 3, wherein the peripheral velocity $v_W$ of the first roller (21) is adjustable for modification of the tension of the web of material (4) so that it is at least one of lower and higher than the velocity $v_B$ of the web of material (4) directly upstream of at least one of the first roller (21) and the second roller (28, 29).

5. A device according to claim 3, wherein a web-tension-measuring device (16) is provided upstream of the at least second roller (28, 29), taking the tension of the web of material (4).

6. A device according to claim 5, wherein a control unit (42) is provided, which is connected to the web-tension-measuring device (16) and the first motor (39) for data transmission, controlling the tension of the web of material (4).

7. A device according to claim 6, wherein the control unit (42) is connected for data transmission to the pivoting drive for the control thereof.

* * * * *